US007874434B2

(12) United States Patent
Yoshizawa

(10) Patent No.: US 7,874,434 B2
(45) Date of Patent: Jan. 25, 2011

(54) SUBSTRATE CARRYING TRAY

(75) Inventor: Takenori Yoshizawa, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 165 days.

(21) Appl. No.: 10/578,321

(22) PCT Filed: Oct. 29, 2004

(86) PCT No.: PCT/JP2004/016093

§ 371 (c)(1),
(2), (4) Date: May 4, 2006

(87) PCT Pub. No.: WO2005/044694

PCT Pub. Date: May 19, 2005

(65) Prior Publication Data

US 2007/0068882 A1 Mar. 29, 2007

(30) Foreign Application Priority Data

Nov. 6, 2003 (JP) ..... 2003-376965

(51) Int. Cl.
*A47G 19/08* (2006.01)

(52) U.S. Cl. ..... 211/41.18; 206/725; 206/509; 206/511; 108/91

(58) Field of Classification Search ..... 211/41.12, 211/41.13, 41.14, 41.17, 41.18, 188, 194, 211/126.2; 206/736, 503, 509, 511, 710, 206/486, 501, 518, 515, 454, 725; 108/180, 108/91, 93, 101, 53.1; 432/259, 258; 220/4.27, 220/23.6; 414/935, 940
See application file for complete search history.

(56) References Cited

U.S. PATENT DOCUMENTS

| | | | | | |
|---|---|---|---|---|---|
| 46,109 | A * | 1/1865 | Jackson | 432/259 |
| 738,980 | A * | 9/1903 | Bradley | 34/238 |
| 1,384,468 | A * | 7/1921 | Howell | 432/259 |
| 1,877,424 | A * | 9/1932 | Fear | 432/259 |
| 1,941,941 | A * | 1/1934 | Irwin | 432/259 |
| 1,971,784 | A * | 8/1934 | Howell | 432/258 |
| 2,233,434 | A * | 3/1941 | Smith | 432/258 |
| 2,352,684 | A * | 7/1944 | Braddock | 220/23.6 |
| 2,738,564 | A * | 3/1956 | Guinane | 432/259 |
| 3,549,018 | A * | 12/1970 | Wilson | 211/126.2 |

(Continued)

FOREIGN PATENT DOCUMENTS

JP 4-48136 U 4/1992

(Continued)

*Primary Examiner*—Darnell M Jayne
*Assistant Examiner*—Stanton L Krycinski
(74) *Attorney, Agent, or Firm*—Birch, Stewart, Kolasch & Birch, LLP

(57) ABSTRACT

A substrate carrying tray capable of horizontally placing a substrate thereon and enabling a plurality of trays to be stacked on each other, comprising an upper contact part coming into contact with one tray disposed on the upper side of the tray when the plurality of the substrates are stacked on each other and a lower contact part coming into contact with the other tray disposed on the lower side. The shapes of the upper contact part and the lower contact part are formed such that, when one tray is placed on the upper side of the tray, the one tray can be moved in the direction that the gravity center of the one tray is disposed just above the gravity center of the tray.

56 Claims, 14 Drawing Sheets

U.S. PATENT DOCUMENTS

| | | | | | |
|---|---|---|---|---|---|
| 3,589,511 | A | * | 6/1971 | Britt | 206/518 |
| 3,695,424 | A | * | 10/1972 | Cristy et al. | 206/455 |
| 4,144,968 | A | * | 3/1979 | Shelton | 206/509 |
| 5,103,976 | A | * | 4/1992 | Murphy | 206/719 |
| 5,211,717 | A | | 5/1993 | Skoura | |
| 5,418,692 | A | * | 5/1995 | Nemoto | 361/809 |
| 5,492,223 | A | * | 2/1996 | Boardman et al. | 206/710 |
| 5,957,293 | A | * | 9/1999 | Pakeriasamy | 206/725 |
| 6,179,127 | B1 | * | 1/2001 | Kato et al. | 206/714 |
| 6,193,506 | B1 | * | 2/2001 | Muka | 432/241 |
| 6,202,883 | B1 | * | 3/2001 | Narazaki et al. | 220/507 |
| 6,264,467 | B1 | * | 7/2001 | Lue et al. | 432/253 |
| 6,357,595 | B2 | * | 3/2002 | Sembonmatsu et al. | 206/726 |
| 6,809,936 | B2 | * | 10/2004 | Chen et al. | 361/807 |
| 6,914,771 | B2 | * | 7/2005 | Ono et al. | 361/679 |
| 2001/0032800 | A1 | | 10/2001 | Numazaki et al. | |
| 2003/0019585 | A1 | | 1/2003 | Tometsuka | |
| 2004/0020823 | A1 | * | 2/2004 | Yoshizawa | 206/706 |
| 2004/0145697 | A1 | * | 7/2004 | Yoshizawa et al. | 349/187 |
| 2004/0181938 | A1 | * | 9/2004 | Suzuki et al. | 29/832 |
| 2005/0069402 | A1 | * | 3/2005 | Yoshizawa et al. | 414/286 |
| 2005/0147488 | A1 | * | 7/2005 | Matsubara et al. | 414/147 |

FOREIGN PATENT DOCUMENTS

| | | | | |
|---|---|---|---|---|
| JP | 5-294375 | A | | 11/1993 |
| JP | 6-1239 | U | | 1/1994 |
| JP | 6-85046 | A | | 3/1994 |
| JP | 6-239349 | A | | 8/1994 |
| JP | 9-8116 | A | | 1/1997 |
| JP | 10-50815 | A | | 2/1998 |
| JP | 10-287382 | A | | 10/1998 |
| JP | 2000281170 | A | * | 10/2000 |
| JP | 2002-2871 | A | | 1/2002 |
| JP | 2002-104575 | A | | 4/2002 |
| JP | 2003-31647 | A | | 1/2003 |
| JP | 2004-149149 | A | | 5/2004 |

* cited by examiner

Conventional Art

SUBSTRATE CARRYING TRAY

TECHNICAL FIELD

The present invention relates to a stackable substrate carrying tray which loads a loaded object.

BACKGROUND ART

In order to transport plural substrates used for a display panel or the like at one time, a substrate transport device as shown in FIG. 27 is commonly employed. The transport device shown in FIG. 27 is constituted by a packing material 201 having a rectangular vertical hole 203, which is made of foam polypropylene or the like. Further, the transport device is formed in a rectangular column (square column) having a bottom, and is provided with ribs 205 on an inner wall of the vertical hole 203. The number of the ribs 205 is one less than the number of substrates to be stored. With the ribs 205, the vertical hole 203 is partitioned and grooves 204 are formed. The number of the grooves 204 is equal to that of the substrates. Further, each of the grooves 204 receives a substrate 202 fitting in so that the substrate 202 is stored. By transporting a set of the substrates stored in such a manner, it is possible to transport the plural substrates at one time.

Further, the Japanese Unexamined Patent Publication, No. 287382/1998 (Tokukaihei 10-287382, publication date: Oct. 27, 1998) discloses an arrangement in which a substrate is loaded on a substrate carrying tray, and which allows plural substrate carrying trays to be stacked one upon another. In the publication, Tokukaihei 10-287382, the substrate carrying tray has a frame on its four edges, the frame having four side surfaces extending in a vertical direction. Further, the frame has four corners on which concave portions are provided so that part of each concave portion has an offset in parallel with each of the side surfaces. Further, in a vertical downward direction from the parts on which the concave portions are provided, convex portions are provided that can fit in the concave portions, respectively. With the above structure, when plural substrate carrying trays are stacked, the convex portions of a substrate carrying tray stacked above fit in concave portions of a substrate carrying tray positioned below. This enables plural substrate carrying trays to be stacked.

However, in such a substrate transport device in which each substrate is stored in a groove of the vertical hole, every substrate is held by ribs 205 only at its edge portion, and no other portions including its center portion are supported. This has caused a fear that, when a substrate is used for a large size display panel, the substrate is warped and the center portion of the substrate contacts the center portion of another substrate, resulting in breakage of the substrate.

Further, the substrate carrying tray described in the publication, Tokukaihei 10-287382, is required to have an elbow room between an outer side surface of every concave portion and an inner side surface of every convex portion, considering manufacturing errors and fitting adjustability. If no elbow room is provided, the following may occur in the case where a substrate carrying tray stacked above is made larger than a substrate carrying tray positioned below. Specifically, the upper substrate carrying tray cannot be fit in the lower substrate carrying tray, so as to run on to the lower substrate carrying tray.

However, providing such an elbow room causes another problem when trays are stacked in multiple levels, e.g. 30 levels. Specifically, when plural substrate carrying trays are stacked, the trays may be slightly inclined leftward or rightward when viewed from a side direction. This causes trays, stacked in multiple levels including levels inclined leftward and levels inclined rightward, to have a waveform as a whole or to have inclination made leftward (or rightward). Thus, stability cannot be attained in the stacked condition.

The present invention is made in view of the foregoing problems, and an object of the present invention is to realize a substrate carrying tray which eliminates a fear of breakage of a substrate when the substrate is warped and contacts another substrate, and which can be stacked stably.

DISCLOSURE OF INVENTION

To attain the foregoing object, a substrate carrying tray of the present invention, on which a substrate is placed horizontally, includes an upper contact section; and a lower contact section, the upper contact section contacting a first substrate carrying tray which is stacked above the substrate carrying tray, and the lower contact section contacting a second substrate carrying tray which is stacked below the substrate carrying tray, the upper and lower contact sections being formed in a shape so as to move, when the first stackable substrate carrying tray is stacked above the substrate carrying tray, the first substrate carrying tray in such a direction that a center of gravity of the first substrate carrying tray is positioned vertically above a center of gravity of the substrate carrying tray.

According to the arrangement, when another substrate carrying tray is stacked on a substrate carrying tray, the upper substrate carrying tray moves so that a center of gravity of the upper substrate carrying tray is positioned vertically above a center of gravity of the lower substrate carrying tray. This allows substrate carrying trays to be aligned substantially linearly in a vertical direction, when the substrate carrying trays are stacked.

This eliminates a fear that the substrates come in contact with each other due to warping of the substrates, resulting in breakage of the substrates. Further, the substrates can be stacked stably.

Further, a substrate carrying tray of the present invention, on which a substrate is placed horizontally, includes an upper contact section; and a lower contact section, the upper contact section contacting a first substrate carrying tray which is stacked above the substrate carrying tray, and the lower contact section contacting a second substrate carrying tray which is stacked below the substrate carrying tray, the upper contact section including an upper inclined section which is inclined inwardly or outwardly in the substrate carrying tray, and the lower contact section including a lower inclined section which has a same inclined direction as that of the upper inclined section.

As used herein, the inclination is not limited to a linear inclination, and may include a curved inclination.

According to the arrangement, it is preferable to use trays having the same shape. This is because substrate carrying trays are aligned substantially linearly in a vertical direction, when the substrate carrying trays are stacked.

The upper and lower contact sections, which constitute a contact region, may be portions where substrate carrying trays come in contact with each other when stacked. Further, the contact region may have a shape corresponding to the shape of a loaded object. For example, there is a case where the loaded object is a large object, e.g. a substrate for a display panel, and the bottom surface of the substrate carrying tray is fully used to place a single loaded object. In such a case, the contact region may be provided on a peripheral edge portion.

In the contact region, its upper-side surface and its lower-side surface may be entirely inclined, or only a portion including an outer edge or a portion including an edge facing the center of the substrate carrying tray may have be inclined, while a portion having the other edge may be a horizontal plane.

According to the arrangement, the upper substrate carrying tray slides down on the lower substrate carrying tray along the inclined surface of the lower substrate carrying tray, and stops when the center of gravity of the upper substrate carrying tray in a horizontal direction and the center of gravity of the lower substrate carrying tray in a horizontal direction become coincident with regard to a vertical line. This prevents a situation from rising where substrate carrying trays are formed in a waveform inclined rightward and leftward, or inclined toward one side, allowing the substrate carrying trays to be stacked linearly. Thus, the substrate carrying trays can be stacked stably.

A substrate carrying tray of the present invention is a stackable substrate carrying tray serving to load a loaded object. Here, when a substrate carrying tray is placed on a horizontal surface, a direction toward the center of the substrate carrying tray is referred to as a center direction, a direction toward the outside of the substrate carrying tray is referred to as an outer direction, and either the center direction or the outer direction is referred to as direction B. Further, the substrate carrying tray has a contact region, on which the loaded object is not loaded and which contacts another substrate carrying tray when substrate carrying trays are stacked. With the above structure, the substrate carrying tray may be arranged such that a surface of an upper-side (simply "upper-side surface" hereinafter) of the contact region has at least a portion that is inclined toward B direction, and a surface of a lower-side (simply "lower-side surface" hereinafter) of the contact region is formed to have an inclined surface that fits an upper-side surface of a contact region of another substrate carrying tray positioned below in the stack.

Further, in addition to the arrangement, the substrate carrying tray of the present invention may be arranged such that the upper and lower contact sections are disposed on a peripheral edge of the substrate carrying tray.

There is a case where the loaded object is a large object, for example, a substrate for a display panel, and the bottom surface of the substrate carrying tray is fully used to place a single loaded object. In such a case, by providing the upper and lower contact sections on the peripheral edge of the substrate carrying tray, it is possible to take a larger portion for placement of a substrate. Further, this provides stability for substrates to be stacked in multiple levels.

By utilizing the peripheral edge for the upper and lower contact sections, which constitute a contact region, there is no need to separately provide a portion having a shape similar to that of the contact region, enabling to realize a simple structure.

In addition to the arrangement, the substrate carrying tray of the present invention may be arranged such that the upper inclined section is provided entirely on an upper surface of the upper contact section, and the lower inclined section is provided entirely on a lower surface of the lower contact section.

According to the arrangement, even when the substrate carrying tray stacked above has a large position shift, the shift can be amended. Specifically, since the inclination is provided on the entire surfaces, even when the position shift is relatively large when substrate carrying trays are stacked, due to the weight of each substrate carrying tray, every substrate carrying tray naturally moves to its initial loading position.

Note that, the substrate carrying tray may be arranged such that the upper-side surface of the contact region is entirely inclined and the lower-side surface of the contact region is entirely formed to have a shape that fits the shape of an upper-side surface of another substrate carrying tray positioned below in the stack.

Further, in addition to the arrangement, the substrate carrying tray of the present invention may be arranged such that the upper inclined section is provided on a portion including an outer edge or inner edge of an upper surface of the upper contact section, and the lower inclined section is provided on a portion of the lower contact section, the portion including an edge corresponding to an edge on which the upper inclined section is disposed.

According to the arrangement, the weight of the substrate carrying tray thus stacked can be supported by a portion having a horizontal surface.

In the contact region, the upper upper-side surface and the lower upper-side surface may be arranged such that only a portion including either one of the outer edge and the edge facing the center of the substrate carrying tray has inclination, while a portion including the other edge may have a horizontal surface.

Further, in addition to the arrangement, the substrate carrying tray of the present invention may be arranged such that at least one of the upper and lower inclined sections are inclined in a plane manner.

According to the arrangement, the upper substrate carrying tray smoothly slides down to the lower carrying transfer tray.

Further, in addition to the arrangement, the substrate carrying tray of the present invention may be arranged such that at least one of the upper inclined section and lower inclined sections are inclined in such a curved manner that a gradient is downwardly moderate.

According to the arrangement, when the upper substrate carrying tray slides down to the lower substrate carrying tray, the upper substrate carrying tray moves at a reduced speed as it comes close to a stop point. This allows the substrate carrying tray to be fit in a predetermined position more quietly.

Further, in addition to the arrangement, the substrate carrying tray of the present invention may be arranged such that the upper and lower inclined sections have an identical shape at respective contact portions.

According to the arrangement, when substrate carrying trays are stacked, the inclined line of the upper substrate carrying tray and the inclined line of the lower substrate carrying tray become coincident regardless of orientations of the substrate carrying tray within the horizontal surface. This allows the substrate carrying trays to be stacked in a preferable manner, enabling to simplify the stacking process.

Further, in addition to the arrangement, a substrate carrying tray may be arranged such that the tray includes a protrusion that engages a chuck for catching the tray, the protrusion outwardly protruding from an outer edge surface of the peripheral edge of the tray, the outer edge surface is formed, in a plane manner, in such a direction that becomes a vertical direction when the tray is placed horizontally, and the upper and lower contact sections are provided inwardly from the outer edge surface.

This means, for example, that no additional "extrusion" is provided other than the protrusion serving as a holding section of a substrate carrying tray at the outer side of the contact region which is a frame made of aluminum or the like. This eliminates a fear that, when chucks of a substrate carrying tray transport device, provided beside stacked substrate carrying trays, come to engage protrusions serving as holding sections of the respective substrate carrying trays in order to transport the trays, the chucks may hook such extrusions. Thus, the substrate carrying trays can be transported smoothly.

When substrate carrying trays are stacked, there may be provided a plane surface having no protrusion at the border between the contact region and a contact region of a stacked substrate carrying tray, with regard to the side surface facing the outside.

According to the arrangement, when another substrate carrying tray is stacked on a substrate carrying tray, the upper substrate carrying tray moves so that the center of gravity of the upper substrate carrying tray is positioned vertically above the center of gravity of the lower substrate carrying tray. This allows substrate carrying trays to be aligned substantially linearly in a vertical direction, when the substrate carrying trays are stacked. This eliminates a fear that substrates come in contact with each other due to warping of the substrate, resulting in breakage of the substrates. Further, the substrates can be stacked stably.

Additional objects, features, and strengths of the present invention will be made clear by the description below. Further, the advantages of the present invention will be evident from the following explanation in reference to the drawings.

BRIEF DESCRIPTION OF DRAWINGS

FIG. 1(*b*) is a plan view schematically illustrating the structure of the substrate carrying tray according to the embodiment of the present invention, when the substrate carrying tray is in a horizontal position and seen from above in a vertical direction.

BEST MODE FOR CARRYING OUT THE INVENTION

Figure 1:
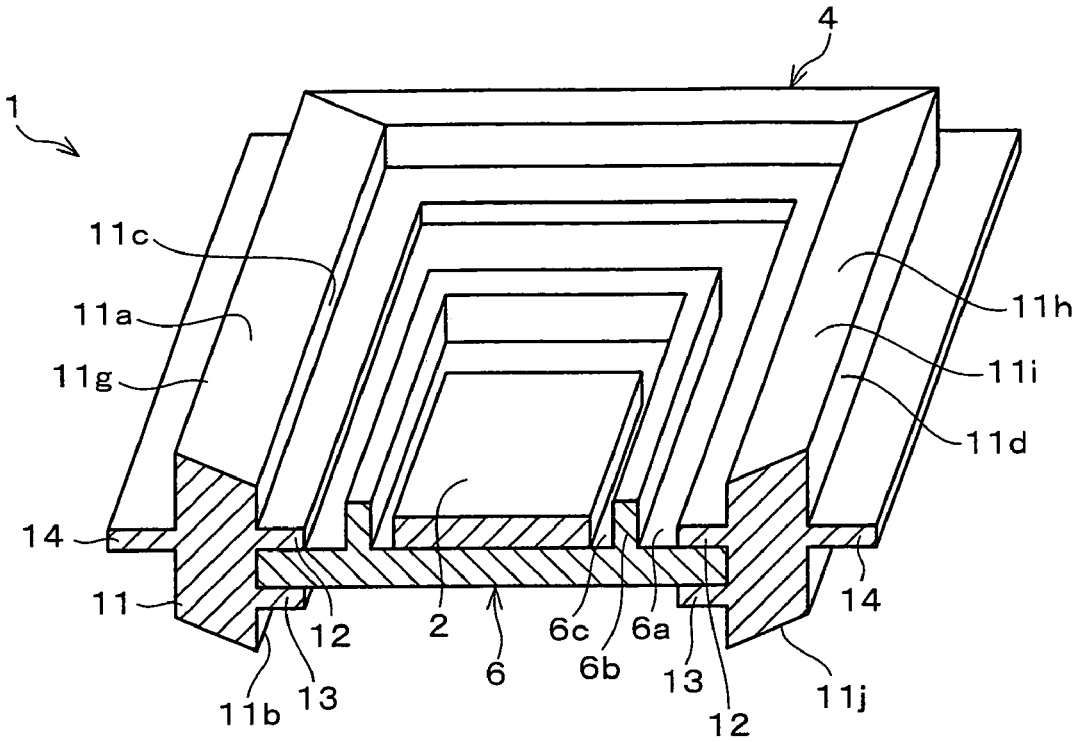
FIG. 1(*a*) is an oblique cross sectional view schematically illustrating a structure of a substrate carrying tray according to an embodiment of the present invention.
Figure 1:
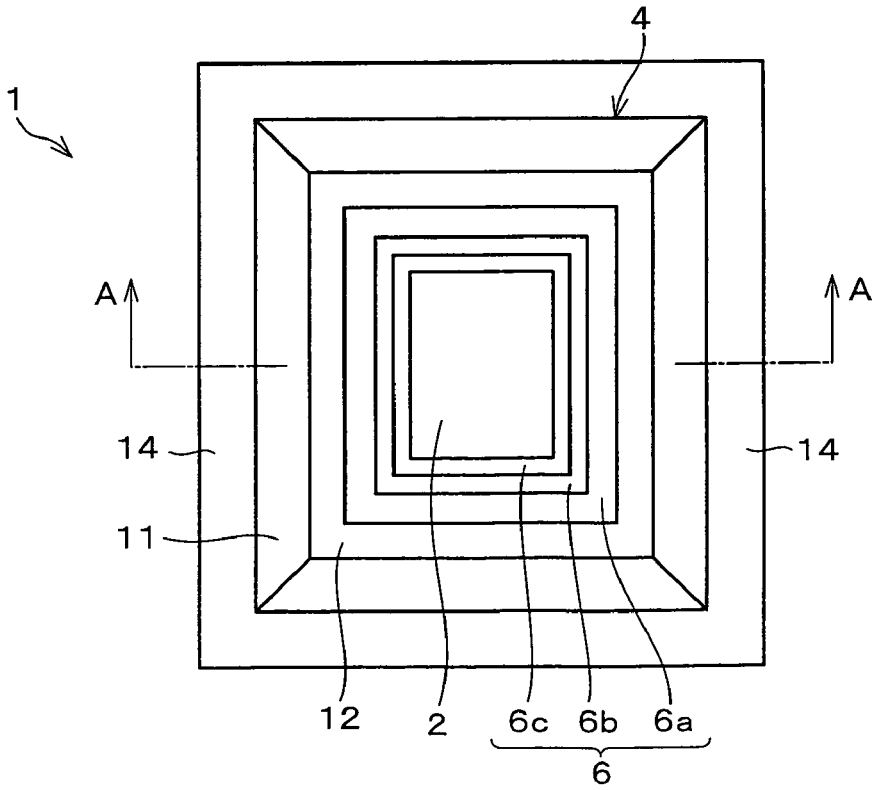

With reference to FIGS. 1(*a*) through 26, one embodiment of the present invention is described below.

As shown in FIGS. 1(*a*) and 1(*b*), a substrate carrying tray 1 serves to load a loaded object, i.e., a glass substrate 2 (hereinafter, simply referred to as substrate 2) used for, for example, a liquid crystal display panel or the like. FIG. 1(*a*) shows a cross section of the substrate carrying tray 1 and the substrate 2 placed on the substrate carrying tray 1, which is taken along a vertical line on the center. In other words, FIG. 1(*a*) is an oblique view taken along line A-A shown in FIG. 1(*b*). Further, FIG. 1(*b*) is a top view of the substrate carrying tray 1 and the substrate 2 placed on the substrate carrying tray 1.

In the following description, as a standard condition, substrate 2 is horizontally placed and constitutes an upper part of the substrate carrying tray 1. Thus, in FIG. 1(*a*), a direction toward the top of the sheet is an upper direction, and a direction toward the bottom of the sheet is a lower direction. Since FIG. 1(*b*) is a top view, the up-and-down direction of the sheet is a depth direction, and a side-to-side direction of the sheet is a width direction.

The substrate carrying tray 1 includes a frame 4 and a loading bed 6. The loading bed 6, held in the center of the frame 4, serves as a bed on which the substrate 2 is placed.

The loading bed 6, serving as loading a substrate thereon, is a flat plate having a frame section 6*b*. The frame section 6*b* has a cross section of a rectangular shape, and its inner perimeter is slightly larger than the outer perimeter of the substrate. The loading bed 6 has an upper surface on which the frame section 6*b* is formed, and a lower surface opposite the upper surface. Further, the upper surface has an outer side section 6*a* that lies outside the frame section 6*b* and an inner side section 6*c*, which lies inside the frame section 6*b*. In the above structure, the substrate 2 is placed on the inner side section 6*c*. Since the frame section 6*b* is provided, when the substrate carrying tray 1 vibrates, the substrate 2 hits frame section 6*b*. This prevents the substrate 2 from being misaligned and falling or from directly hitting the frame 4 so as to be broken on impact. Regarding this, the loading bed 6 is made of a material that can absorb such impact, for example, foam polyethylene. The outer side section 6*a* is a portion fixed to the frame 4.

The frame 4, formed to surround the outer edge of the loading bed 6, includes a frame body 11, a pair of an upper side fixing section 12 and a lower side fixing section 13, and a flange 14. The upper side fixing section 12 and the lower side fixing section 13 respectively have ribs on planes, and the ribs protrude from an inner edge surface 11*c* of the frame body 11 to the inside. Further, the flange 14 protrudes from an outer edge surface 11*d* of the frame body 11 toward the outside.

Figure 2:
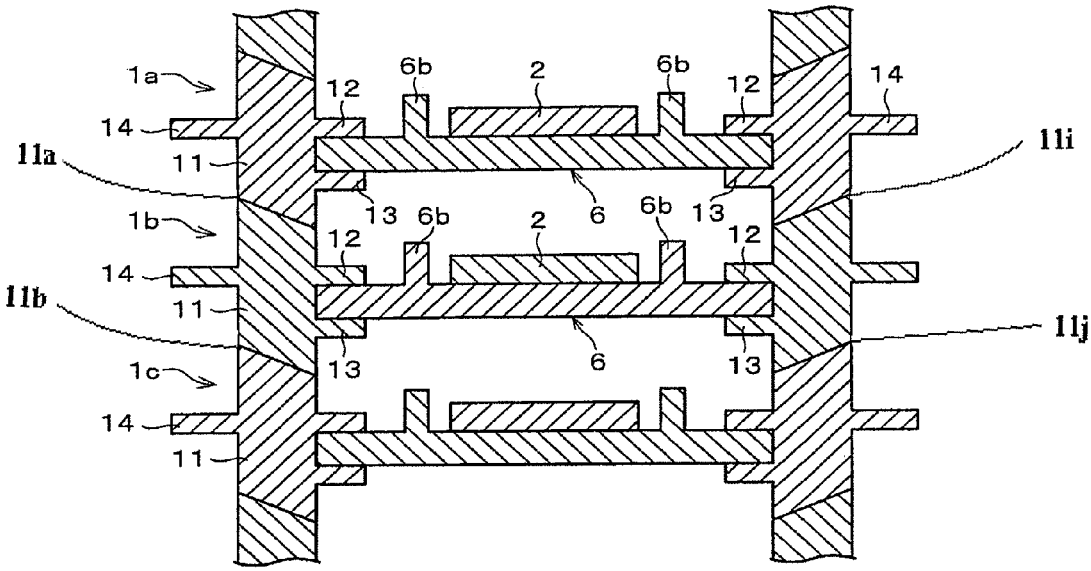
FIG. 2 is a cross sectional view schematically illustrating a structure of stacked substrate carrying trays.

FIG. 2 shows substrate carrying trays stacked one upon another. As shown in FIG. 2, the frame body 11 includes upper contact sections 11*a* and 11*i* and lower contact sections 11*b* and 11*j*, which constitute a contact region. The upper contact sections 11*a* and 11*i* contacts a substrate carrying tray stacked above, and the lower contact sections 11*b* and 11*j* contacts a substrate carrying tray positioned below. The upper contact sections 11*a* and 11*i* and the lower contact sections 11*b* and 11*j* are formed with such inclination that their heights in a vertical direction are reduced from their outer edges down to their inner edges. In the present embodiment, the inclination is created with the same angle for the upper contact sections and the lower contact sections. Further, the upper contact sections and the lower contact sections have the same width. That is, the upper contact sections and the lower contact sections are the same with regard to the shape and the inclination.

The upper contact sections 11*a* and 11*i* have inclined regions referred to as upper inclined regions, and the lower contact sections 11*b* and 11*j* also have inclined regions referred to as lower inclined regions. The upper inclined regions and the lower inclined regions are formed to have inclination toward same direction.

In the present embodiment, since the entire surfaces of the upper contact sections 11*a* and 11*i* and the lower contact sections 11*b* and 11*j* are inclined, the upper contact sections 11*a* and 11*i* are respectively the same portions as the upper inclined sections, and the lower contact sections 11*b* and 11*j* are respectively the same portions as the lower inclined sections. However, if inclination is not created for the entire surfaces, the upper contact sections 11*a* and 11*i* will be different from the upper inclined sections, and the lower contact sections 11*b* and 11*j* will be different from the lower inclined sections.

The upper side fixing section 12 and the lower side fixing section 13 are formed so as to have a gap in which the loading bed 6 can be sandwiched. By sandwiching the loading bed 6 in between, the upper side fixing section 12 and the lower side fixing section 13 support the periphery of the loading bed 6.

The flange 14 engages chucks 89 of a substrate carrying tray transport device 88 (see FIG. 4), which will be described later, when the substrate carrying tray 1 is entirely lifted. In the present embodiment, as an example, the flange 14 is provided in the form of a flat plate having a uniform thickness, extending in a horizontal direction from the entire region of the outer side surface 11*d*. However, the shape of the flange 14 is not limited to this, and may be selected in accordance with the shape of the chucks 89 appropriately. For example, in the case where chucks engage respective predetermined opposing sides, flanges 14 may be provided on sides of the outer side surface 11*d*, which respectively face to each other, in the frame body 11 (e.g. side 11*g* and side 11*h*). As long as the flange 14 is stably supported by the chucks 89, the flange 14 may be formed in other shapes.

The outer side surface lid of the frame body 11 is preferably formed to have a plane surface extending in a vertical direction except the portion on which the flange 14 is provided. It is further preferable that the plane surface have no protrusion and dent. Providing no protrusion and dent allows the chucks to engage and lift the substrate carrying tray 1, without causing the chucks 89 to catch protrusion and dent. Thus, it is possible to realize stable operation of the substrate carrying tray transport device 88.

As described above, the flange 14 is a protrusion (cassette catch section) that engages the chucks for catching the substrate carrying tray 1. Further, the upper contact sections 11*a* and 11*i* and the lower contact sections 11*b* and 11*j* are positioning sections which serve to perform position alignment of the loading bed 6, using the upper side fixing section 12 and the lower side fixing section 13. In the present embodiment, the flange 14 serving as the cassette catch section is provided in different portions from the upper contact sections 11*a* and 11*i* and the lower contact sections 11*b* and 11*j*. When a chuck catches the substrate carrying tray 1, the cassette catch section is subjected to a force resulting from the weight of the substrate carrying tray 1. However, with the above structure, the positioning sections are free from the force, unlike the case where the cassette catch section and the positioning sections are provided in the same portions. This allows suppression with regard to (i) deformation of the substrate carrying tray 1, (ii) degradation in accuracy for positioning the loading bed 6, and (iii) the like.

When the aforesaid substrate carrying tray 1 is stacked so as to form plural levels as shown in FIG. 2, lower contact sections 11*b* and 11*j* of a substrate carrying tray 1*a* stacked above fit in the inclined portions, i.e., upper contact sections 11*a* of a substrate carrying tray 1*b*. The substrate carrying tray 1*b* and a substrate carrying tray 1*c* positioned immediately below the substrate carrying tray 1*b* fit in the similar manner. When the substrate carrying tray 1*a* is placed on the substrate carrying tray 1*b*, the position of the substrate carrying tray 1*a* may be slightly shifted. Even in such a case, due to the action of gravity in the inclined surfaces, the substrate carrying tray 1*a* moves so that the center of gravity of the substrate carrying tray 1*a* and the center of gravity of the substrate carrying tray 1*b* are aligned along a vertical direction. This allows, even when plural substrate carrying trays 1 are stacked, each level of the substrate carrying trays 1 to be automatically aligned in a horizontal direction. Thus, even when substrate carrying trays 1 are stacked in multiple levels, e.g. 50 levels, no irregularities occur in the levels, with regard to the vertical direction.

Figure 3:
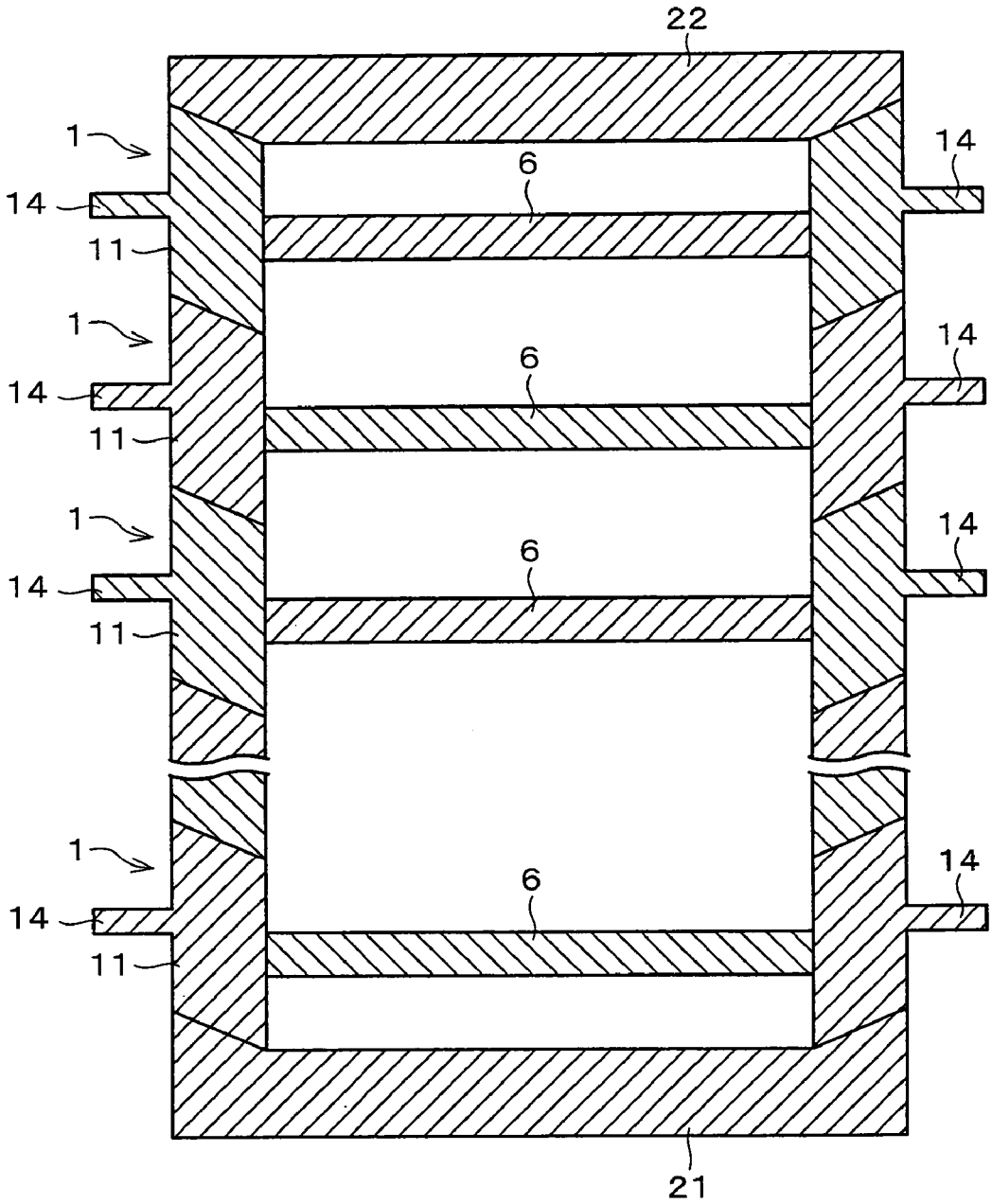
FIG. 3 is a cross sectional view schematically illustrating a structure of stacked substrate carrying trays.

FIG. 3 shows a state in which substrate carrying trays 1 are stacked in multiple levels. In FIG. 3, the structure of a loading bed 6 is simplified. A substrate carrying tray 1 in the bottom level is stably placed on a base 21, which has a contact section with a top face having the same shape as that of an upper contact section. Further, it is desirable to avoid particle contamination on a glass substrate used for a liquid crystal display device or the like. To this end, on a substrate carrying tray 1 in the top level, a cap 22 is placed that has a contact section formed in the same shape as that of a lower contact section. With the cap 22, particle contamination can be prevented.

Figure 4:
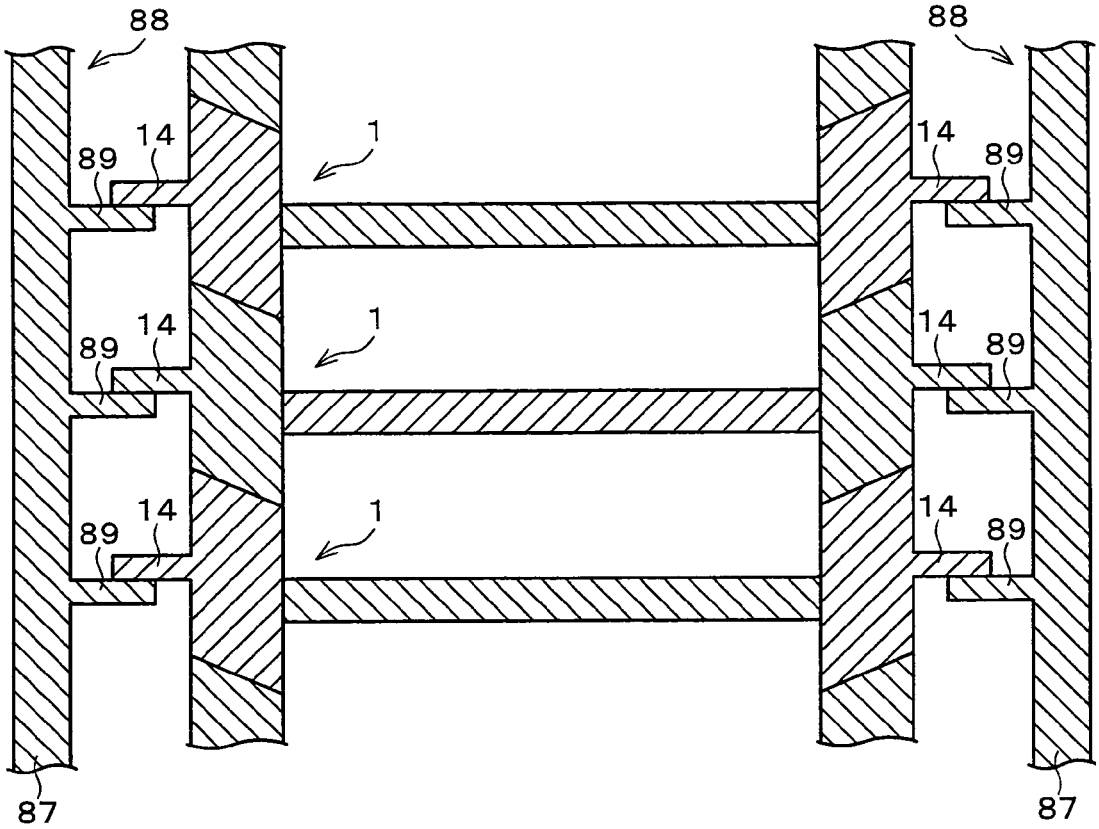
FIG. 4 is a cross sectional view schematically illustrating how substrate carrying trays are stacked, and transported by a substrate carrying tray transport device.

Such substrate carrying trays 1 are transported to another device by the substrate carrying tray transport device 88, as shown in FIG. 4. The substrate carrying tray transport device 88 is provided with a pair of arms 87 and chucks 89. The arms 87 are spaced from each other with a distance larger than the width of a substrate carrying tray 1. Further, the chucks 89, provided on inner surfaces of the arms 87, are spaced from each other with a distance equal to a gap provided between flanges 14 of substrate carrying trays positioned adjacent to each other when the substrate carrying trays 1 are stacked in multiple levels.

The pair of the arms 87 is provided so as to be freely driven in the width direction of the substrate carrying trays 1, and the distance between the arms 87 can be changed appropriately. First, the distance between the arms 87 is provided large enough so that inner edges of the chucks 89 do not touch the flanges 14, respectively. Further, the arms 87 placed outside the substrate carrying trays are moved downwards, i.e., from the direction of the upper substrate carrying trays toward the lower substrate carrying trays, which are stacked in multiple levels. Next, the arms 87 are moved so that the distance between the pair of arms 87 is reduced and the inner edges of the chucks 89 are respectively positioned beneath the flanges 14, with the result that the chucks engage the flanges 14, respectively. Further, the pair of the arms 87 is moved upwards with the chucks 89 engaged with the flanges 14, respectively, so that the substrate carrying trays 1 are lifted. In this way, the substrate carrying tray transport device transports the substrate carrying trays.

Figure 22:
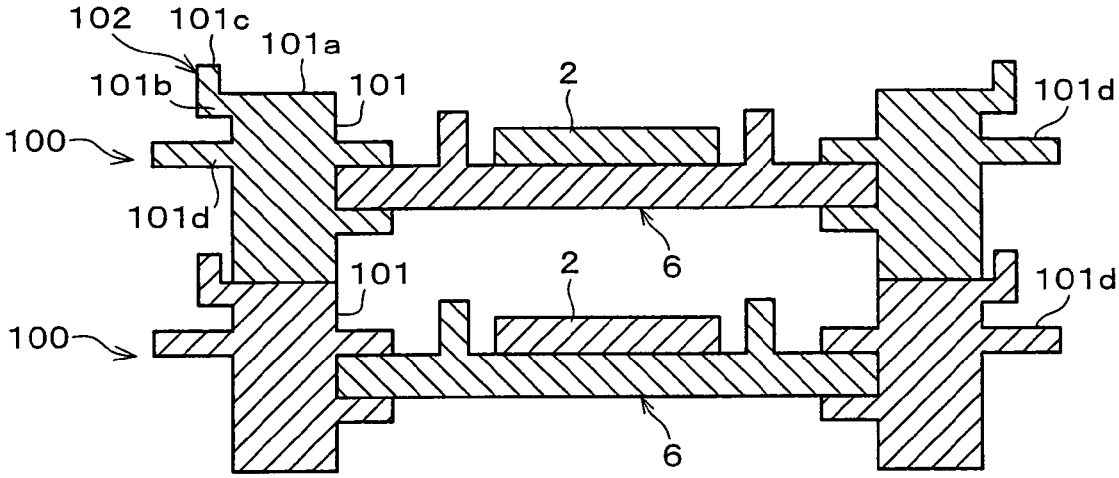
FIG. 22 is a cross sectional view schematically illustrating substantial parts of comparative substrate carrying trays.
Figure 26:
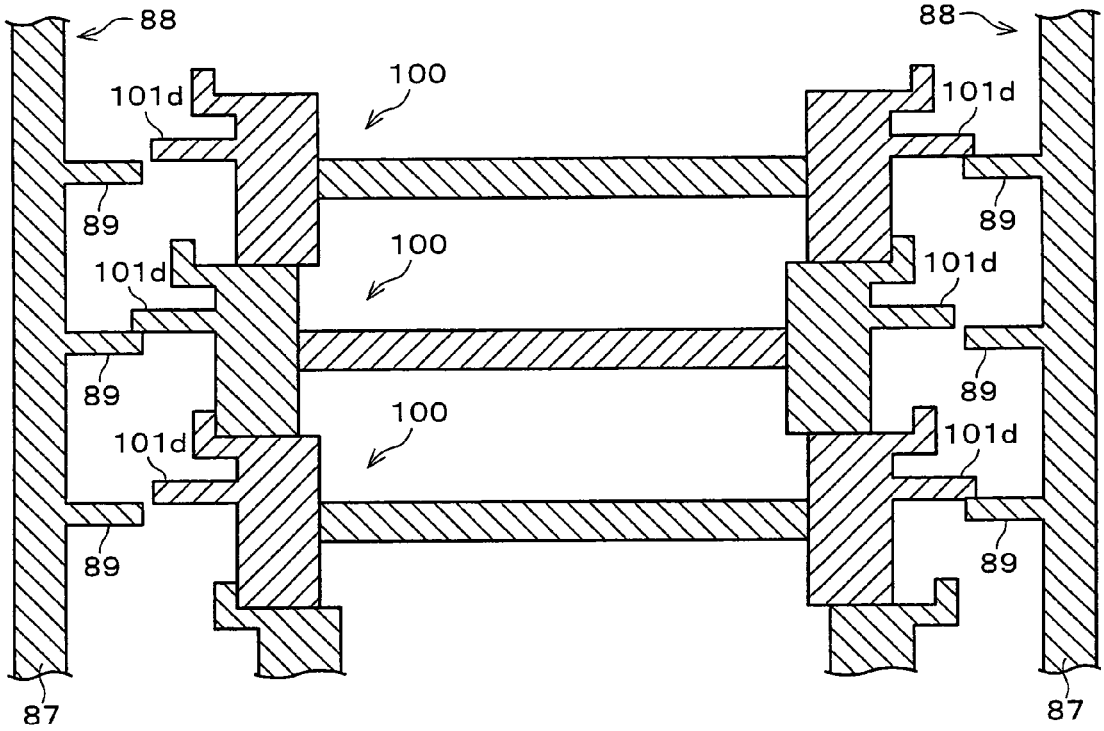
FIG. 26 is a cross sectional view schematically illustrating how comparative substrate carrying trays are stacked, and transported by a substrate carrying tray transport device.
Figure 27:
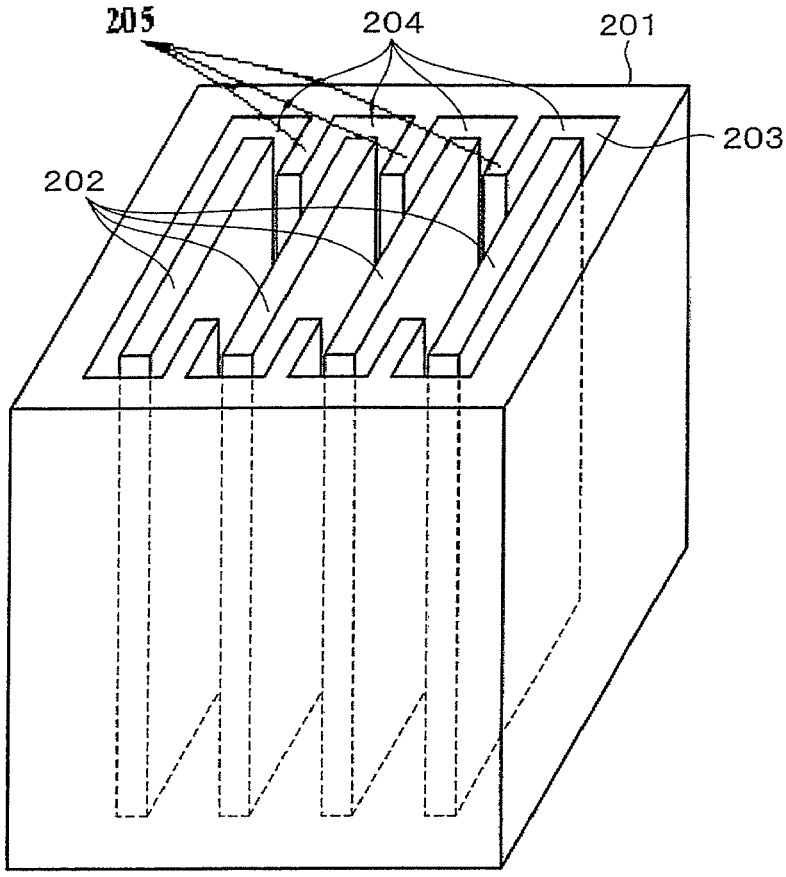
FIG. 27 is an oblique view schematically illustrating substantial parts of a conventional package material for storing and transporting substrates.

With reference to FIGS. 22 and 26, description is made as to structures comparable to the substrate carrying tray 1 (hereinafter, referred to as comparative structures). In the comparative structures, as is the case with the substrate carrying tray 1, a substrate 2 used for, for example, a liquid crystal display panel or the like is loaded as a loaded object.

In the comparative structures, as shown in FIG. 22, each substrate carrying tray 100 is formed so that an upper contact section and a lower contact section of a frame body 101 are horizontal. Further, the upper contact section has a frame protrusion 102 on its outer top edge. The frame protrusion 102 serves to prevent each substrate carrying tray stacked above from slipping when plural substrate carrying trays are stacked. Further, a flange 101*d* is provided so as to protrude from an outer surface of the frame body 101 toward the outside.

The frame protrusion 102 includes (i) a protrusion 101*b* serving as a top outer edge extending section, and (ii) a protrusion 101*c*. The protrusion 101*b* protrudes from a top end of the frame body 101 for a substrate carrying tray, extending from the outer surface of the frame body outwardly in a horizontal direction. Further, the protrusion 101*c* is formed so as to extend in a vertical upward direction from an outer edge of the protrusion 101*b*.

Figure 23:
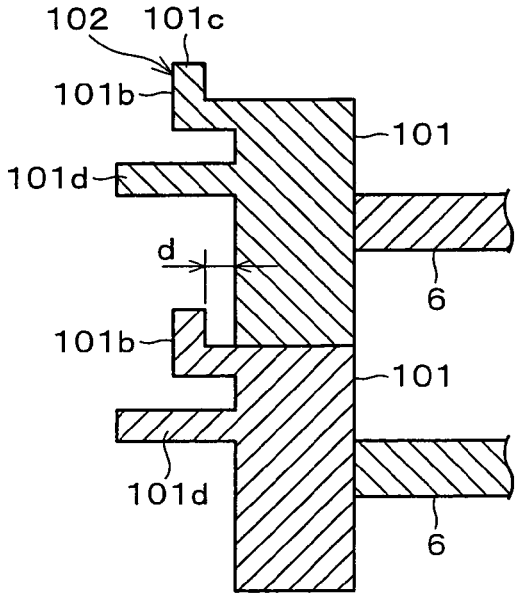
FIG. 23 is a cross sectional view schematically illustrating substantial parts of comparative substrate carrying trays.

The protrusion 101*b* and the protrusion 101*c* are both provided to extend along an entire top outer edge of the frame body 101. The protrusion 101*c* is formed so that an inner surface of the protrusion 101*c* positions outside an outer surface of a bottom end of a frame body 101. Thus, when substrate carrying trays 100 are stacked in multiple levels, the above structure allows a bottom end of a frame body 101 of a substrate carrying tray 100 stacked above to fit in an inner portion of a top end of a frame body 101. If the fitting is tight, removal is difficult. Further, if a manufacturing error is large, it is feared that the lower side substrate carrying tray may run on to a face of the edge surface 101*c* when the upper substrate carrying tray is placed on the lower substrate carrying tray. Regarding this, an elbow room having a certain distance or more is provided between (i) the inner surface of the top end of the substrate carrying tray positioned below and (ii) the outer surface of the bottom end of the substrate carrying tray stacked above. The foregoing structure is shown in FIG. 23. In FIG. 23, d indicates a distance between a bottom end of a frame body 101 of a substrate carrying tray 100 stacked above and an inner surface of a top end of a frame body 101 (the distance corresponds to the aforementioned elbow room).

Figure 24:
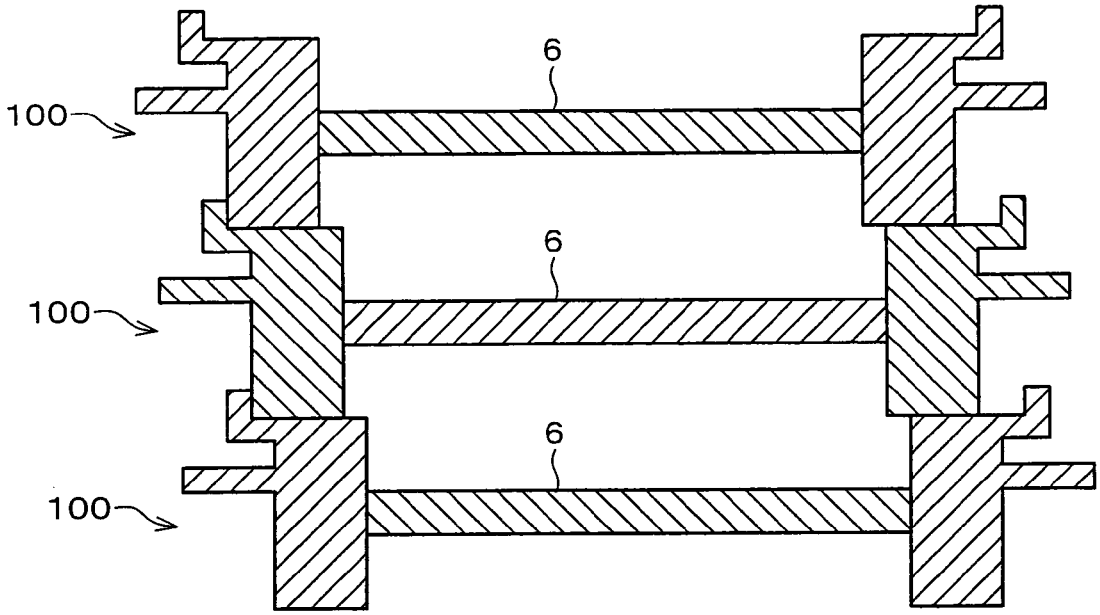
FIG. 24 is a cross sectional view schematically illustrating substantial parts of comparative substrate carrying trays.
Figure 25:
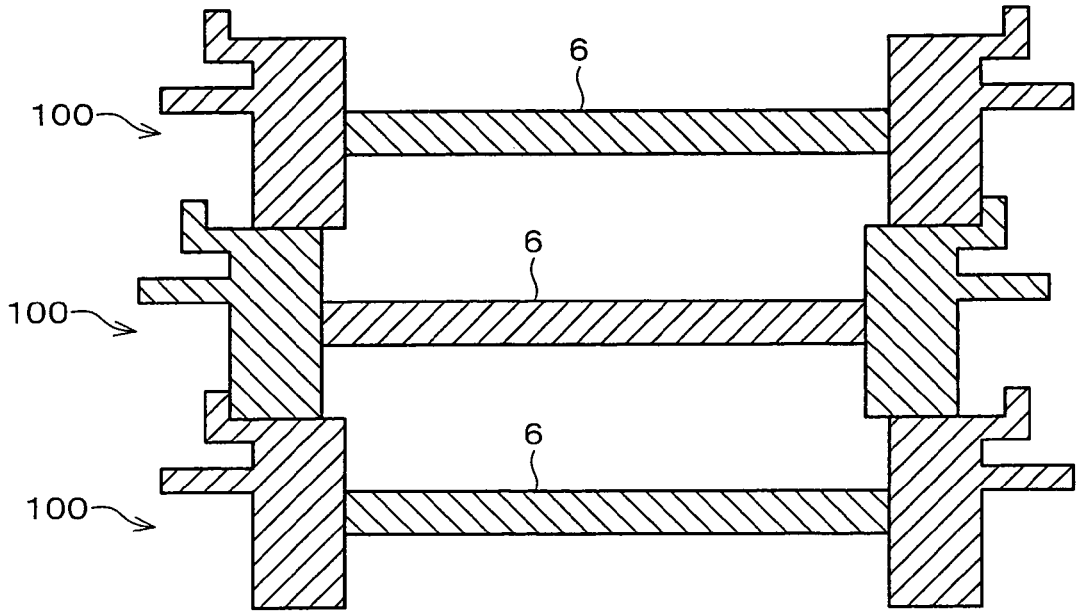
FIG. 25 is a cross sectional view schematically illustrating substantial parts of comparative substrate carrying trays.

As to a substrate carrying tray 100 of the comparative structures shown in FIGS. 22 through 26, there are provided the equivalents of the upper side fixing section 12 and the lower side fixing section 13 that are described in the present embodiment (see FIGS. 1(*a*) and 1(*b*)), although their drawings are omitted. Further, a substrate 2 and a loading bed 6 respectively have the same shapes as those shown in FIGS. 1(*a*) and 1(*b*). In FIGS. 24, 25, and 26, although the structure of the loading bed 6 is simplified, there is no particular difference from that shown in FIG. 22.

As described above, it is necessary to provide such an elbow room with a certain distance or more between (i) the inner surface of the top end of the substrate carrying tray positioned below and (ii) the outer surface of the bottom end of the substrate carrying tray stacked above. However, when substrate carrying trays are stacked in multiple levels, the elbow room will cause a problem. Specifically, the elbow room allows a substrate carrying tray 100 stacked above to move freely within a range of the elbow room, causing position shift in every level.

When substrate carrying trays are stacked in multiple levels, as shown in FIG. 24, such a shift is accumulated. This produces a large shift in a lateral direction between substrate carrying trays close to the top level and substrate carrying trays close to the bottom level. Further, as shown in FIG. 25, as substrate carrying trays are stacked from the bottom level to the top level, the substrate carrying trays will be in a skew form like a waveform in the lateral direction. That is, the substrate carrying trays cannot be stacked linearly. This aggravates the stability of the entire substrate carrying trays 100 stacked in multiple levels.

Further, the above structure may cause the following situations, which result in faulty transfer operations. As shown in FIG. 26, when the substrate carrying tray transport device 88 lifts the substrate carrying trays 100 by means of the chucks 89, the chucks 89 do not sufficiently engage the protrusions 101*d*, respectively. As a result, the substrate carrying trays are not lifted. Further, there is another case where a chuck 89 on one side catches a bottom surface of a protrusion 101*b*, which protrudes from an outer surface of a frame body 101. As a result, the substrate carrying trays 100 are lifted, while being inclined.

On the contrary, with the structure according to the present embodiment, such faulty transfer operations will not occur even when a substrate carrying tray 1 is placed at a slightly shifted position. This is because the center of gravity of a substrate carrying tray thus stacked moves so as to be positioned vertically above the center of gravity of a substrate carrying tray positioned immediately below the substrate carrying tray thus placed. Specifically, this allows the substrate carrying tray thus stacked to be aligned linearly in a vertical direction.

Further, when substrate carrying tray 1 is stacked above, as long as the substrate carrying tray 1 is not shifted beyond the region where the inclination is provided, the substrate carrying tray thus placed is automatically aligned linearly in a vertical direction. Thus, the structure according to the present embodiment is preferable allowing such a shift within a certain degree.

Figure 5:
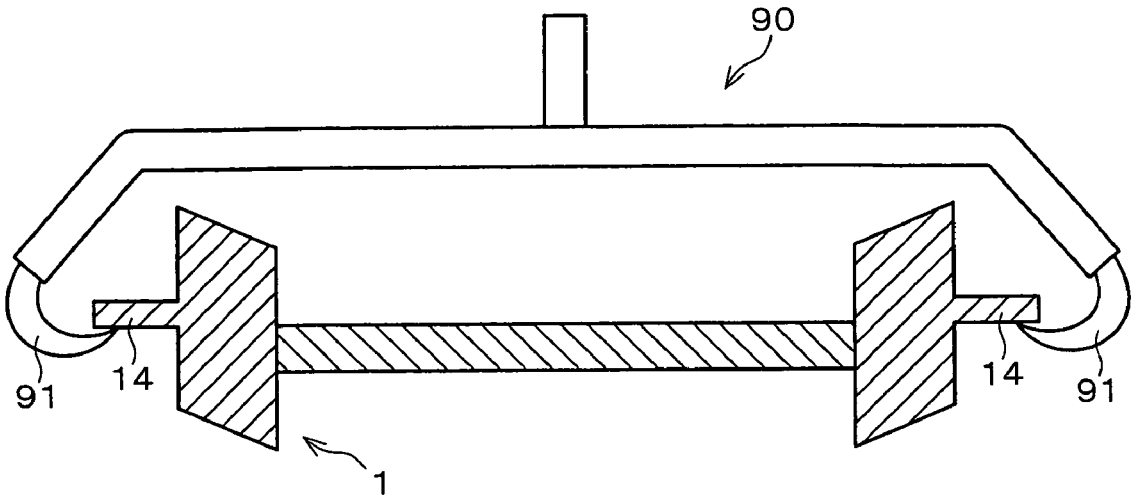
FIG. 5 is a cross sectional view schematically illustrating how substrate carrying trays are stacked, and transferred by a substrate carrying tray transport device.

The embodiment described above can be modified in various ways. As to the substrate carrying tray transport device 88, a substrate carrying tray transport device 90 shown in FIG. 5 can be also used other than the substrate carrying tray transport device 88 shown in FIG. 4. The substrate carrying tray transport device 90 includes chucks 91 having a nail shape. Each of the chucks 91 catches a flange 14 protruding from a substrate carrying tray 1. With the chucks 91, a substrate carrying tray 1 is transported one by one. According to the present invention, substrate carrying trays are aligned in a vertical line. Thus, it is possible to catch each of the substrate carrying trays at a certain position, without performing position alignment even in the case where the chucks 91 are used.

Further, the shape of the upper and lower contact section of the frame body 11 of a substrate carrying tray 1 is not limited to the above structures. In the following, modifications (varieties) will be described referring to FIGS. 6 through 19. Note that, the structure of the loading bed 6 is simplified in the drawings. Further, constituting elements arranged in the same manner as those shown in FIGS. 1(*a*) and 1(*b*) are indicated by the same reference numerals, and their explanations are omitted. Further, in all of the following modifications, description is made as to a structure in which the entire edge portion surrounding the loading bed 6 has inclination, as is the case with FIGS. 1(*a*) and 1(*b*). Such inclination may be created on only part of the edge portion, including the case shown in FIGS. 1(*a*) and 1(*b*).

Figure 6:
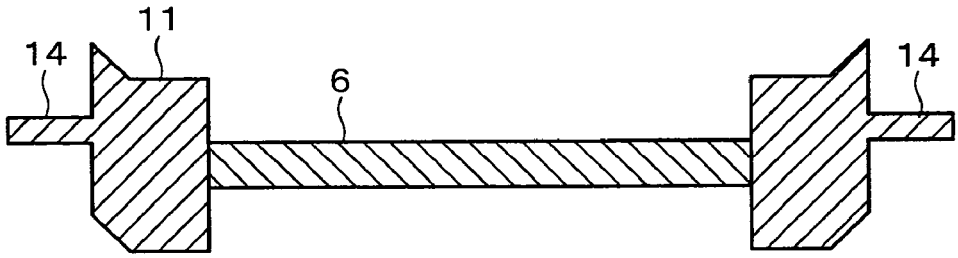
FIG. 6 is a cross sectional view schematically illustrating substantial parts of a substrate carrying tray.

In a structure of FIG. 6, as is the case with FIGS. 1(*a*) and 1(*b*), a frame body 11 for a substrate carrying tray 1 is arranged such that upper contact sections 11*a* and 11*i* and lower contact sections 11*b* and 11*j* are inclined so that their inner sides are lower than their outer sides. However, the upper contact sections are not entirely inclined. Specifically, only portions including their outer peripheral edges constitute upper inclined sections having inclination, and the other portions including the inner edges have horizontal surfaces. Further, the lower contact sections are not inclined entirely, and only portions including the outer peripheral edges constitute the lower inclined sections having inclination. With the above structure, when a substrate carrying tray is stacked on upper inclined sections and thereby substrate carrying trays are positioned immediately above and below, the center of gravity of the substrate carrying tray stacked above moves so as to be positioned vertically above the center of gravity of a substrate carrying tray positioned immediately below the substrate carrying tray thus stacked. This allows the substrate carrying tray thus stacked to be aligned linearly in a vertical direction, enabling to achieve the similar operation effects.

Figure 7:
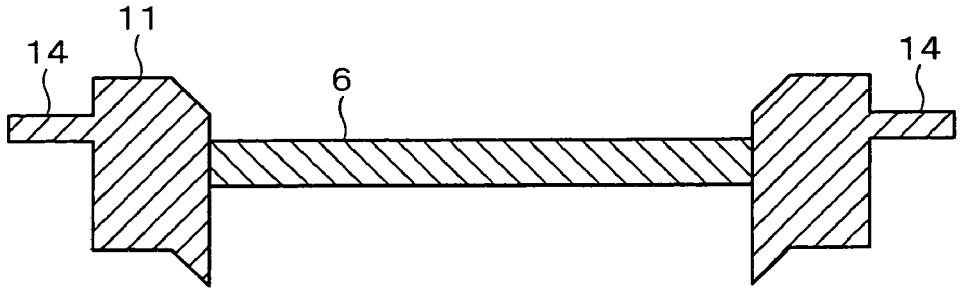
FIG. 7 is a cross sectional view schematically illustrating substantial parts of a substrate carrying tray.

In a structure shown in FIG. 7, as is the case with FIGS. 1(*a*) and 1(*b*), a frame body 11 for a substrate carrying tray 1 is arranged such that upper contact sections 11*a* and 11*i* and lower contact sections 11*b* and 11*j* are inclined so that their inner sides are lower than their outer sides. However, the upper contact sections are not entirely inclined. Specifically, only portions including their inner peripheral edges constitute upper inclined sections having inclination, and the other portions including the inner edges have horizontal surfaces. Further, the lower contact sections are not inclined entirely, and only portions including the inner peripheral edges constitute the lower inclined sections having inclination. With the above structure, when a substrate carrying tray is stacked on upper inclined sections and thereby substrate carrying trays are positioned immediately above and below, the center of gravity of the substrate carrying tray stacked above moves so as to be positioned vertically above the center of gravity of a substrate carrying tray positioned immediately below the substrate carrying tray thus stacked. This allows the substrate carrying tray thus stacked to be aligned linearly in a vertical direction, enabling to achieve the similar operation effects.

Figure 8:
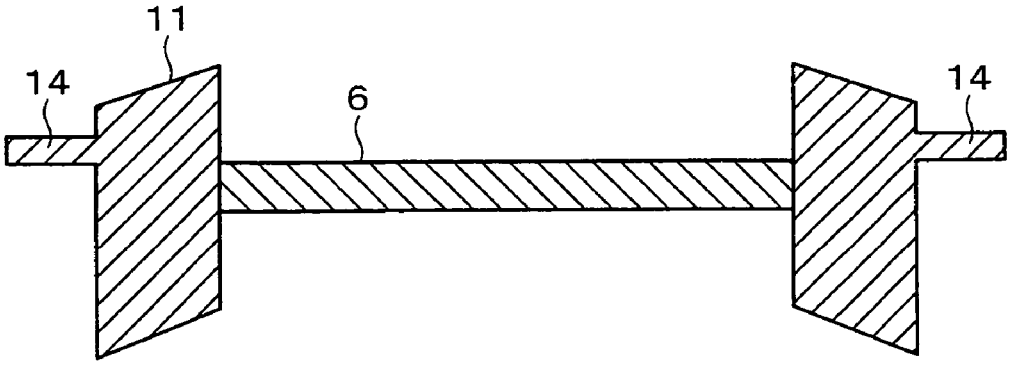
FIG. 8 is a cross sectional view schematically illustrating substantial parts of a substrate carrying tray.

In a structure of FIG. 8, as is the case with FIGS. 1(*a*) and 1(*b*), a frame body 11 for a substrate carrying tray 1 is arranged such that upper contact sections 11*a* and 11*i* and lower contact sections 11*b* and 11*j* are entirely inclined so that their outer sides are lower than their inner sides. With this shape, it is possible to achieve effects similar to those obtained in the structure shown in FIGS. 1(*a*) and 1(*b*).

Figure 9:
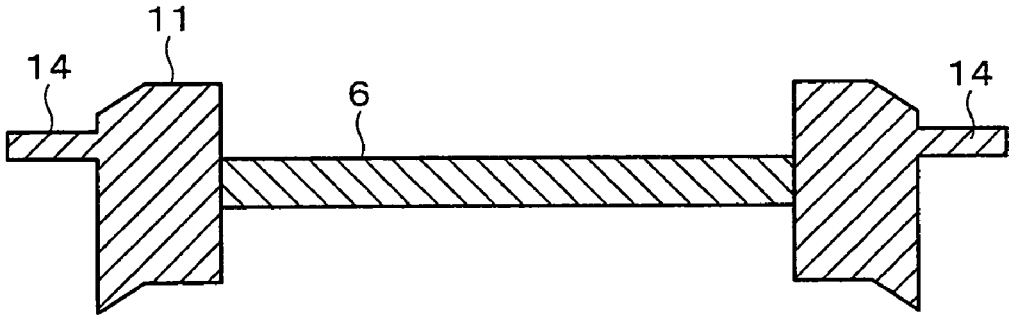
FIG. 9 is a cross sectional view schematically illustrating substantial parts of a substrate carrying tray.

In a structure of FIG. 9, as is the case with FIG. 8, a frame body 11 for a substrate carrying tray 1 is arranged such that upper contact sections 11*a* and 11*i* and lower contact sections 11*b* and 11*j* are inclined so that their inner sides are lower than their outer sides. However, the upper contact sections are not entirely inclined. Specifically, only portions including their outer peripheral edges constitute upper inclined sections having inclination, and the other portions including the inner edges have horizontal surfaces. Further, the lower contact sections are not inclined entirely, and only portions including the outer peripheral edges constitute the lower inclined sections having inclination. With the structure it is possible to achieve effects similar to those obtained in the structure shown in FIG. 6.

Figure 10:
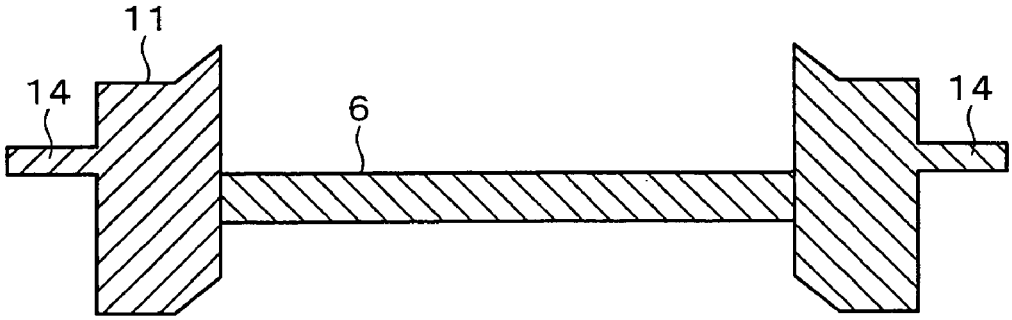
FIG. 10 is a cross sectional view schematically illustrating substantial parts of a substrate carrying tray.

In a structure of FIG. 10, as is the case with FIG. 8, a frame body 11 for a substrate carrying tray 1 is arranged such that upper contact sections 11*a* and 11*i* and lower contact sections 11*b* and 11*j* are inclined so that their inner sides are lower than their outer sides. However, the upper contact sections are not entirely inclined. Specifically, only portions including their inner peripheral edges constitute upper inclined sections having inclination, and the other portions including the inner edges have horizontal surfaces. Further, the lower contact sections are not inclined entirely, and only portions including the inner peripheral edges constitute the lower inclined sections having inclination. With the structure, it is possible to achieve effects similar to those obtained in the structure shown in FIG. 7.

Figure 11:
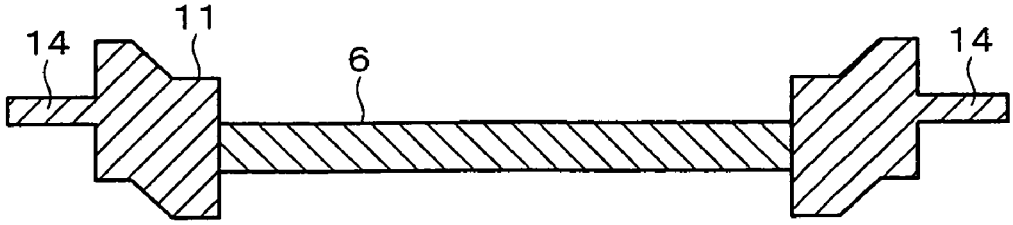
FIG. 11 is a cross sectional view schematically illustrating substantial parts of a substrate carrying tray.

In a structure of FIG. 11, as is the case with FIGS. 1(*a*) and 1(*b*), a frame body 11 for a substrate carrying tray 1 is arranged such that upper contact sections 11*a* and 11*i* and lower contact sections 11*b* and 11*j* are inclined so that their inner sides are lower than their outer sides. However, in upper contact sections and lower contact sections, a region including inner peripheral edges of the respective contact sections and a region including outer peripheral edges of the respective contact sections are horizontal, and only a portion sandwiched by the both regions (intermediate portion) has an inclined surface. Even in this case, when a substrate carrying tray is stacked on upper inclined sections of a substrate carrying tray positioned immediately below, the center of gravity of a substrate carrying tray stacked above moves so as to be positioned vertically above the center of gravity of a substrate carrying tray positioned immediately below the substrate carrying tray thus stacked. This allows the substrate carrying tray thus stacked to be aligned linearly in a vertical direction, enabling to achieve the similar operation effects.

Figure 12:
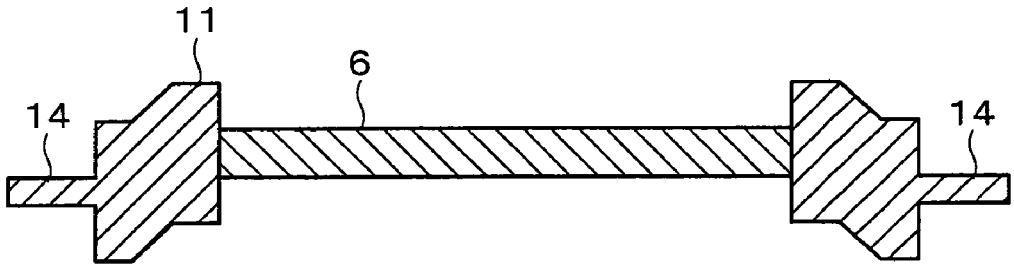
FIG. 12 is a cross sectional view schematically illustrating substantial parts of a substrate carrying tray.

In a structure of FIG. 12, as is the case with FIG. 8, a frame body 11 for a substrate carrying tray 1 is arranged such that upper contact sections 11*a* and 11*i* and lower contact sections 11*b* and 11*j* are inclined so that their inner sides are lower than their outer sides. However, in upper contact sections and lower contact sections, a region including inner peripheral edges of the respective contact sections and a region including outer peripheral edges of the respective contact sections are horizontal, and only a portion sandwiched by the both regions (intermediate portion) has an inclined surface. Even in this case, when lower inclined sections of a substrate carrying tray stacked above are placed on upper inclined sections of a substrate carrying tray positioned immediately below, the center of gravity of the substrate carrying tray stacked above moves so as to be positioned vertically above the center of gravity of the substrate carrying tray positioned immediately below the substrate carrying tray thus stacked. This allows the substrate carrying tray thus stacked to be aligned linearly in a vertical direction, enabling to achieve the similar operation effects.

In the foregoing structures, all the inclined surfaces are inclined in a plane manner. However, the inclined surfaces may be inclined in a curved manner. Examples of the surfaces inclined in a curved manner are shown in FIGS. 13 through 19.

Figure 13:
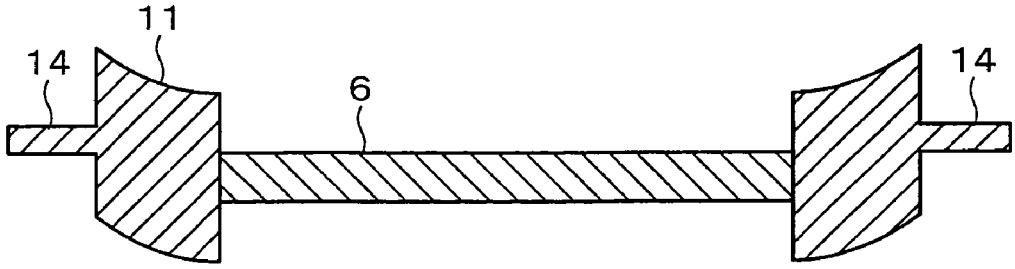
FIG. 13 is a cross sectional view schematically illustrating substantial parts of a substrate carrying tray.

FIG. 13 is a view illustrating a modification example of FIGS. 1(*a*) and 1(*b*). In FIG. 13, inclined surfaces are inclined in a curved manner, not in a plane manner, so that a gradient is downwardly moderate. This makes it possible to achieve the effects similar to those obtained in the structure shown in FIGS. 1(*a*) and 1(*b*).

Figure 14:
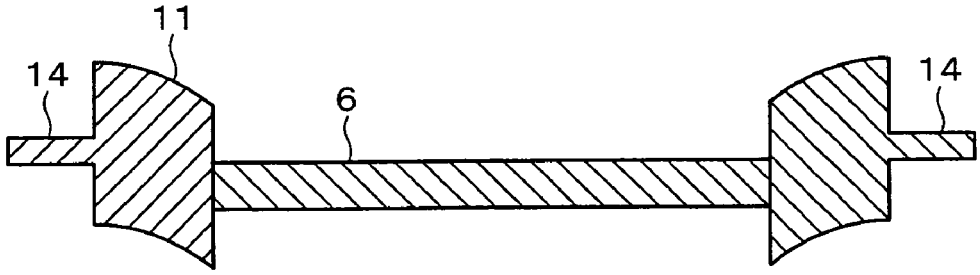
FIG. 14 is a cross sectional view schematically illustrating substantial parts of a substrate carrying tray.

FIG. 14 is a view illustrating a modification example of FIGS. 1(*a*) and 1(*b*). In FIG. 14, inclined surfaces are inclined in a curved manner, not in a plane manner, so that a gradient is upwardly moderate. This makes it possible to achieve the effects similar to those obtained in the structure shown in FIGS. 1(*a*) and 1(*b*).

Figure 15:
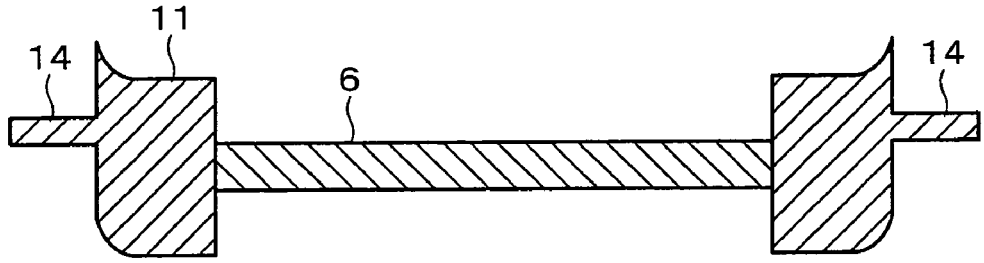
FIG. 15 is a cross sectional view schematically illustrating substantial parts of a substrate carrying tray.

FIG. 15 is a view illustrating a modification example of FIG. 6. In FIG. 15, inclined surfaces are inclined in such a curved manner that a gradient is downwardly moderate. This makes it possible to achieve the effects similar to those obtained in the example shown in FIG. 6.

Figure 16:
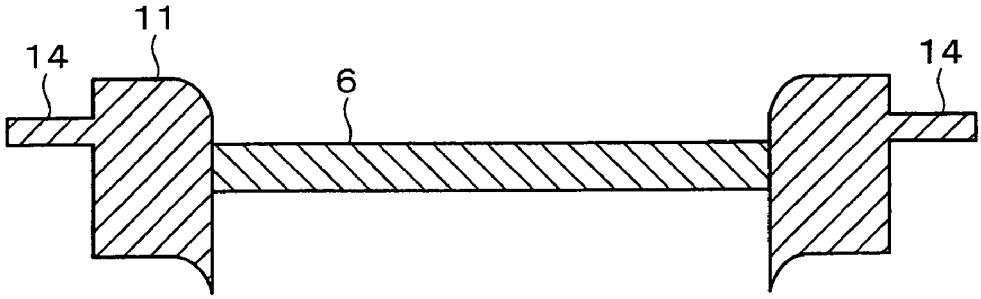
FIG. 16 is a cross sectional view schematically illustrating substantial parts of a substrate carrying tray.

FIG. 16 is a view illustrating a modification example of FIG. 7. In FIG. 16, inclined surfaces are inclined in such a curved manner that a gradient is upwardly moderate. This makes it possible to achieve the effects similar to those obtained in the structure shown in FIG. 7.

Figure 17:
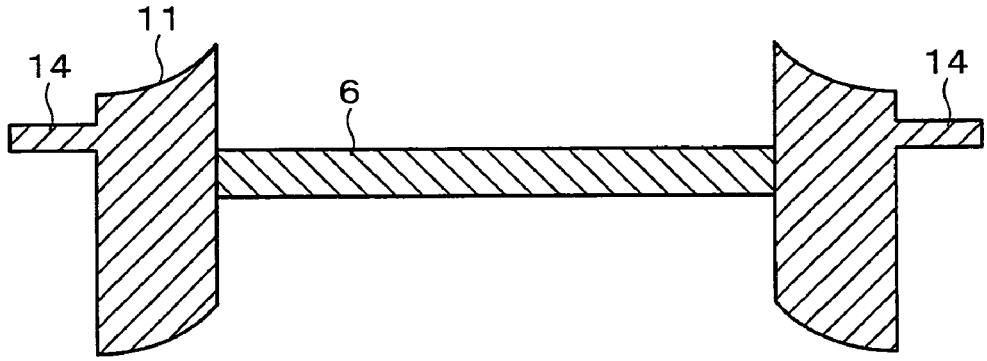
FIG. 17 is a cross sectional view schematically illustrating substantial parts of a substrate carrying tray.

FIG. 17 is a view illustrating a modification example of FIG. 8. In FIG. 17, inclined surfaces are inclined in a curved manner, not in a plane manner, so that a gradient is downwardly moderate. This makes it possible to achieve the effects similar to those obtained in the structure shown in FIG. 8.

Figure 18:
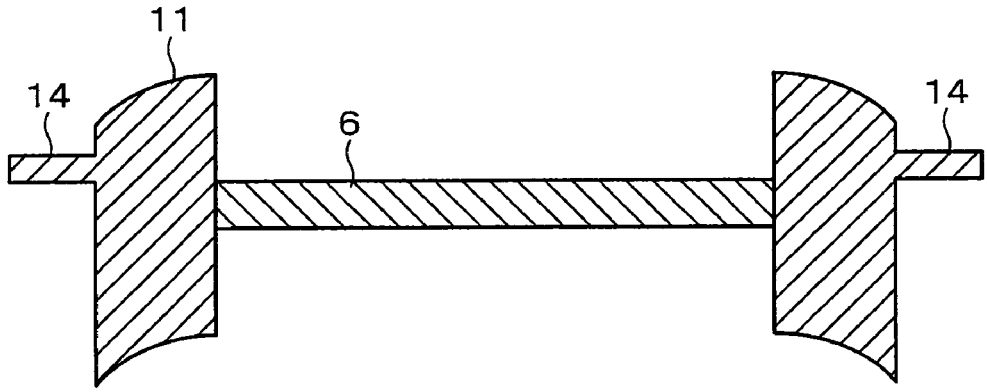
FIG. 18 is a cross sectional view schematically illustrating substantial parts of a substrate carrying tray.

FIG. 18 is a view illustrating a modification example of FIG. 8. In FIG. 18, inclined surfaces are inclined in a curved manner, not in a plane manner, so that a gradient is upwardly moderate. This makes it possible to achieve the effects similar to those obtained in the structure shown in FIG. 8.

Figure 19:
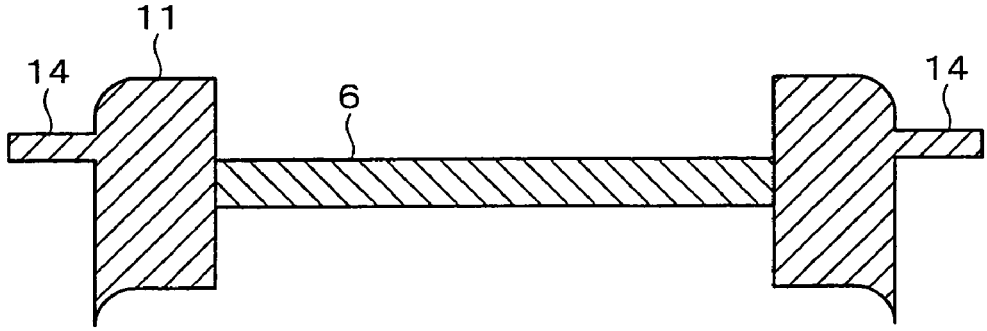
FIG. 19 is a cross sectional view schematically illustrating substantial parts of a substrate carrying tray.

FIG. 19 is a view illustrating a modification example of FIG. 9. In FIG. 19, inclined surfaces are inclined in such a curved manner that a gradient is downwardly moderate. This makes it possible to achieve the effects similar to those obtained in the structure shown in FIG. 9.

Figure 20:
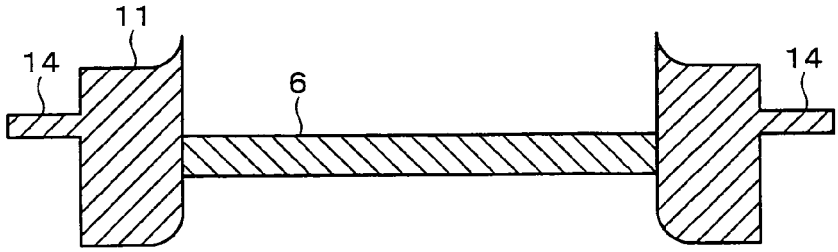
FIG. 20 is a cross sectional view schematically illustrating substantial parts of a substrate carrying tray.

FIG. 20 is a view illustrating a modification example of FIG. 10. In FIG. 20, inclined surfaces are inclined in such a curved manner that a gradient is upwardly moderate. This makes it possible to achieve the effects similar to those obtained in the structure shown in FIG. 10.

Figure 21:
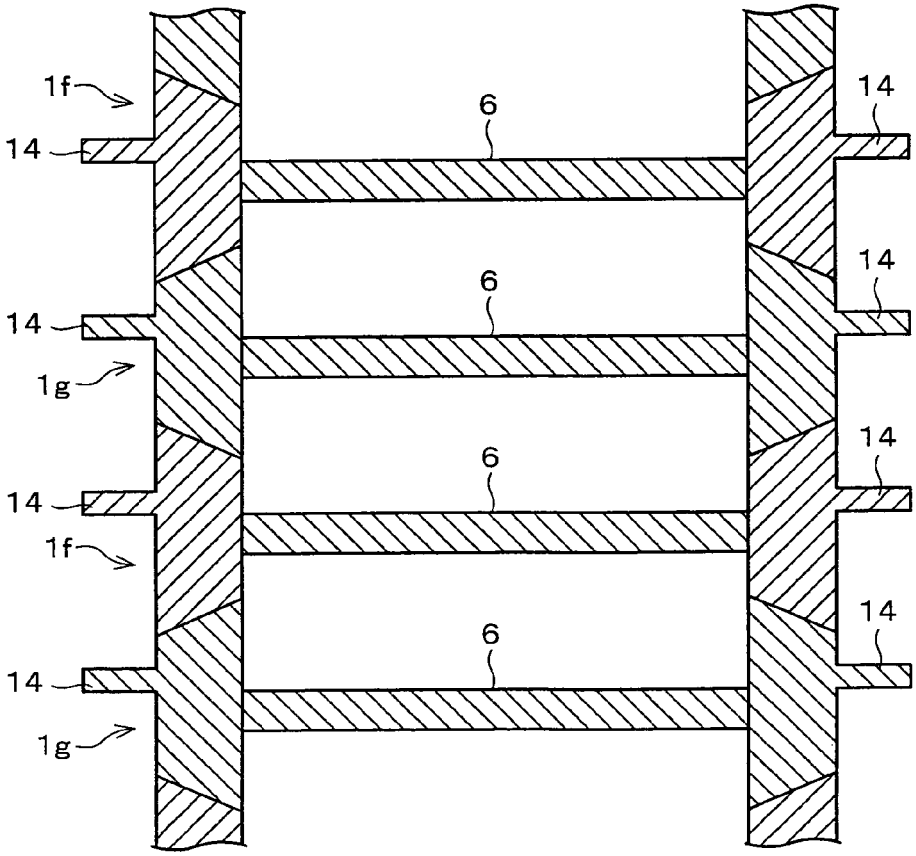
FIG. 21 is a cross sectional view schematically illustrating substantial parts of a substrate carrying tray.

In each of the foregoing structures, every contact region is inclined toward the same direction. However, as shown in FIG. 21, upper and lower inclined sections may be inclined toward reversed directions. First, two types of substrate carrying trays are made: a substrate carrying tray 1*f* and a substrate carrying tray 1*g*. The substrate carrying tray 1*f* has (i) an upper inclined section which is inclined so that its inner side is lower than its outer side, and (ii) a lower inclined section which is inclined so that its outer side is lower than its inner side. Further, the substrate carrying tray 1*g* has (i) an upper inclined section which is inclined so that its outer side is lower than its inner side, and (ii) a lower inclined section which is inclined so that its inner side is lower than its outer side. Then, the two types of the substrate carrying trays are stacked one upon another. Note that, in this case, the substrate carrying trays 1*f* and 1*g* should be stacked alternately. In the structure, as is the case with all the other structures, even when a substrate carrying tray is stacked above at a slightly shifted position, the center of gravity of the substrate carrying tray thus stacked moves so as to be positioned vertically above the center of gravity of the substrate carrying tray positioned immediately below. This allows the stacked substrate carrying trays to be aligned linearly in a vertical direction.

Further, in all of the foregoing structures, upper and lower contact sections have the same shape (the upper contact sections are formed in a shape so that the entire upper contact sections face the entire lower contact sections in an equal manner, when substrate carrying trays are stacked). With the above structure, the entire upper substrate carrying tray can be supported stably.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention eliminates a fear that loaded objects, i.e., substrates, are warped and come in contact with each other, resulting in breakage of the substrates. Further, the present invention allows substrate carrying trays to be stacked stably. Thus, the present invention is used for transportation of plural stacked trays or for other use.

The invention claimed is:

1. A stackable substrate carrying tray for placing a substrate horizontally thereon, being stackable by making an upper contact section of the substrate carrying tray contact a lower surface of an upper tray and by making a lower contact section of the substrate carrying tray contact an upper surface of a lower tray, comprising:

a loading bed for loading the substrate; and a frame provided to surround an outer edge of the loading bed, wherein the frame includes a frame body, an upper side fixing section and a lower side fixing section, the upper side fixing section and the lower side fixing section inwardly protruding from an inner edge surface of the frame body so as to sandwich an outer edge of the loading bed, wherein the frame includes the upper contact section having an upper inclined section and the lower contact section having a lower inclined section, wherein:

the loading bed includes a frame section whose inner perimeter is larger than an outer perimeter of the substrate, and there is a gap between the upper side fixing section and the frame section.

2. The stackable substrate carrying tray according to claim 1, wherein the loading bed is made of a material that can absorb impact in order to prevent the substrate from being misaligned and falling or from directly hitting the frame.

3. The stackable substrate carrying tray according to claim 2, wherein the loading bed is made of foam polyethylene.

4. The stackable substrate carrying tray according to claim 1, wherein the frame includes a protrusion that engages a chuck for catching the stackable substrate carrying tray, the protrusion outwardly protruding from an outer edge surface of a peripheral edge of the frame.

5. The stackable substrate carrying tray according to claim 1, wherein each of the upper contact section and the lower contact section includes a first region having an inner edge, a second region having an outer edge and an intermediate region between the first and second regions, the first and second regions being horizontal and only the intermediate region being inclined.

6. The stackable substrate carrying tray according to claim 1, wherein an inner edge is lower than an outer edge of the upper inclined section, and an outer edge is lower than an inner edge of the lower inclined section.

7. The stackable substrate carrying tray according to claim 1, wherein an outer edge is lower than an inner edge of the upper inclined section, and an inner edge is lower than an outer edge of the lower inclined section.

8. The stackable substrate carrying tray according to claim 1, wherein the upper contact section is formed in a shape enabling to move back the upper tray to a standard situation by making the lower surface of the upper tray move back on the upper contact section of the stackable substrate carrying tray by use of gravity and inclination of the upper contact section, when the upper tray has moved on the stackable substrate carrying tray so as to go out of the standard situation due to moving of the lower surface of the upper tray on the upper contact section of the stackable substrate carrying tray, the standard situation being a situation wherein a center of gravity of the upper tray is positioned right above a center of gravity of the stackable substrate carrying tray.

9. The stackable substrate carrying tray according to claim 8, wherein the lower inclined section has a same inclined direction as that of the upper inclined section.

10. The stackable substrate carrying tray according to claim 9, wherein the upper and lower contact sections are disposed on a peripheral edge of the substrate carrying tray.

11. The stackable substrate carrying tray according to claim 10, wherein the upper and lower contact sections are different from a protrusion that engages a chuck for catching the stackable substrate carrying tray.

12. The stackable substrate carrying tray according to claim 10, wherein the stackable substrate carrying tray includes a protrusion that engages a chuck for catching the stackable substrate carrying tray, the protrusion outwardly protruding from an outer edge surface of the peripheral edge of the stackable substrate carrying tray, the outer edge surface is formed, in a plane manner, in such a direction that becomes a vertical direction when the stackable substrate carrying tray is placed horizontally, and the upper and lower contact sections are provided inwardly from the outer edge surface.

13. The stackable substrate carrying tray according to claim 9, wherein:

the upper inclined section is provided entirely on an upper surface of the upper contact section, and the lower inclined section is provided entirely on a lower surface of the lower contact section.

14. The stackable substrate carrying tray according to claim 9, wherein:

the upper inclined section is provided on a portion including an outer edge or inner edge of an upper surface of the upper contact section, and the lower inclined section is provided on a portion of the lower contact section, the portion including an edge corresponding to an edge on which the upper inclined section is disposed.

15. The stackable substrate carrying tray according to claim 9, wherein at least one of the upper and lower inclined sections are inclined in a plane manner.

16. The stackable substrate carrying tray according to claim 9, wherein at least one of the upper and lower inclined sections are inclined in such a curved manner that the lower a position is, the more gradual a gradient is.

17. The stackable substrate carrying tray according to claim 9, wherein the upper and lower inclined sections have an identical shape at respective contact portions.

18. The stackable substrate carrying tray according to claim 9, wherein the upper contact section contacting the upper substrate carrying tray which is stacked above said substrate carrying tray by only the surface of the upper contact section and the lower contact section contacting the lower substrate carrying tray which is stacked below said substrate carrying tray by only the surface of the lower contact section, and wherein the surface of the upper contact section and the surface of the lower contact section have the same surface area, the same shape, and the same inclination.

19. The stackable substrate carrying tray according to claim 8, wherein the substrate carrying tray has such a shape that the upper substrate carrying tray is not in contact with the substrate when the substrate is placed on said substrate carrying tray.

20. The stackable substrate carrying tray according to claim 8, wherein the substrate carrying tray has such a shape that there is a space between a lower end of the upper substrate carrying tray and an upper end of the substrate when the substrate is placed on said substrate carrying tray.

21. The stackable substrate carrying tray according to claim 8, wherein the upper and lower contact sections each has such a shape that a space inside the frame is an enclosed space when the substrate carrying tray, the upper tray and the lower tray are stacked on each other.

22. The stackable substrate carrying tray according to claim 8, wherein the frame section of the loading bed has such a shape that the upper substrate carrying tray is not in contact with the substrate when the substrate is placed on said substrate carrying tray.

23. The stackable substrate carrying tray according to claim 8, wherein the frame section of the loading bed has such a shape that there is a space between a lower end of the upper substrate carrying tray and an upper end of the frame section.

24. The stackable substrate carrying tray according to claim 8, wherein an upper end of the frame section of the loading bed is lower than an upper end of the upper contact section and higher than an upper end of the substrate placed on the substrate carrying tray.

25. The stackable substrate carrying tray according to claim 8, wherein the upper and lower contact sections each has such a shape that the upper and lower contact sections, connected to each other, constitute a post which extends vertically when the substrate carrying tray, the upper tray and the lower tray are stacked on each other.

26. The stackable substrate carrying tray according to claim 8, wherein two or more substrates can be vertically placed and carried by a structure that three or more stackable substrate carrying trays are stacked.

27. The stackable substrate carrying tray according to claim 8, wherein the upper contact section contacting the upper substrate carrying tray which is stacked above said substrate carrying tray by only an angled portion of the upper contact section and the lower contact section contacting the lower substrate carrying tray which is stacked below said substrate carrying tray by only an angled portion of the lower contact section, and wherein the angled portion of the upper contact section and the angled portion of the lower contact section have equal width and the same inclination.

28. The stackable substrate carrying tray according to claim 8, wherein, at one end of the stackable substrate carrying tray, an entire slope of a surface for contact with the upper tray has only one of an upslope and a downslope toward the interior of the stackable substrate carrying tray.

29. The stackable substrate carrying tray according to claim 28, wherein, at any end of the stackable substrate carrying tray, the slope of the surface for contact with the upper tray shows a same variation of either an upslope or a downslope towards the interior of the stackable substrate carrying tray.

30. A stackable substrate carrying tray for placing a substrate horizontally thereon, being stackable by making an upper contact section of the substrate carrying tray contact a lower surface of an upper tray and by making a lower contact section of the substrate carrying tray contact an upper surface of a lower tray, comprising:

a loading bed for loading the substrate; and a frame provided to surround an outer edge of the loading bed, wherein the frame includes the upper contact section having at least one upper inclined section and the lower contact section having at least one lower inclined section, each of the upper and lower inclined sections being a slope of either ascending type or descending type towards a center of the loading bed, so that, in each of the upper and lower contact sections, there is only one type of slope ascending type and descending type, whereby the upper contact section contacts but does not fixedly engage the lower contact section of the upper tray and thereby enables free sliding of the upper tray on the upper contact section, and wherein the upper contact section is formed in a shape enabling to move back the upper tray to a standard situation by making the lower surface of the upper tray move back on the upper contact section of the stackable substrate carrying tray by use of gravity and inclination of the upper contact section, when the upper tray has moved on the stackable substrate carrying tray so as to go out of the standard situation due to moving of the lower surface of the upper tray on the upper contact section of the stackable substrate carrying tray, the standard situation being a situation wherein a center of gravity of the upper tray is positioned right above a center of gravity of the stackable substrate carrying tray.

31. The stackable substrate carrying tray according to claim 30, wherein the frame includes a protrusion that engages a chuck for catching the stackable substrate carrying tray, the protrusion outwardly protruding from an outer edge surface of a peripheral edge of the frame.

32. The stackable substrate carrying tray according to claim 30, wherein each of the upper contact section and the lower contact section includes a first region having an inner edge, a second region having an outer edge and an intermediate region between the first and second regions, the first and second regions being horizontal and only the intermediate region being inclined.

33. The stackable substrate carrying tray according to claim 30, wherein an inner edge is lower than an outer edge of the upper inclined section, and an outer edge is lower than an inner edge of the lower inclined section.

34. The stackable substrate carrying tray according to claim 30, wherein an outer edge is lower than an inner edge of the upper inclined section, and an inner edge is lower than an outer edge of the lower inclined section.

35. The stackable substrate carrying tray according to claim 30, wherein the lower inclined section has a same inclined direction as that of the upper inclined section.

36. The stackable substrate carrying tray according to claim 35, wherein the upper and lower contact sections are disposed on a peripheral edge of the substrate carrying tray.

37. The stackable substrate carrying tray according to claim 36, wherein the upper and lower contact sections are different from a protrusion that engages a chuck for catching the stackable substrate carrying tray.

38. The stackable substrate carrying tray according to claim 36, wherein the stackable substrate carrying tray includes a protrusion that engages a chuck for catching the stackable substrate carrying tray, the protrusion outwardly protruding from an outer edge surface of the peripheral edge of the stackable substrate carrying tray, the outer edge surface is formed, in a plane manner, in such a direction that becomes a vertical direction when the stackable substrate carrying tray is placed horizontally, and the upper and lower contact sections are provided inwardly from the outer edge surface.

39. The stackable substrate carrying tray according to claim 35, wherein:

the upper inclined section is provided entirely on an upper surface of the upper contact section, and the lower inclined section is provided entirely on a lower surface of the lower contact section.

40. The stackable substrate carrying tray according to claim 35, wherein:

the upper inclined section is provided on a portion including an outer edge or inner edge of an upper surface of the upper contact section, and the lower inclined section is provided on a portion of the lower contact section, the portion including an edge corresponding to an edge on which the upper inclined section is disposed.

41. The stackable substrate carrying tray according to claim 35, wherein at least one of the upper and lower inclined sections are inclined in a plane manner.

42. The stackable substrate carrying tray according to claim 35, wherein at least one of the upper and lower inclined sections are inclined in such a curved manner that the lower a position is, the more gradual a gradient is.

43. The stackable substrate carrying tray according to claim 35, wherein the upper and lower inclined sections have an identical shape at respective contact portions.

44. The stackable substrate carrying tray according to claim 35, wherein the upper contact section contacting the upper substrate carrying tray which is stacked above said substrate carrying tray by only the surface of the upper contact section and the lower contact section contacting the lower substrate carrying tray which is stacked below said substrate carrying tray by only the surface of the lower contact section, and wherein the surface of the upper contact section and the surface of the lower contact section have the same surface area, the same shape, and the same inclination.

45. The stackable substrate carrying tray according to claim 30, wherein the substrate carrying tray has such a shape that the upper substrate carrying tray is not in contact with the substrate when the substrate is placed on said substrate carrying tray.

46. The stackable substrate carrying tray according to claim 30, wherein the substrate carrying tray has such a shape that there is a space between a lower end of the upper substrate carrying tray and an upper end of the substrate when the substrate is placed on said substrate carrying tray.

47. The stackable substrate carrying tray according to claim 30, wherein the upper and lower contact sections each has such a shape that a space inside the frame is an enclosed space when the substrate carrying tray, the upper tray and the lower tray are stacked on each other.

48. The stackable substrate carrying tray according to claim 30, wherein the upper and lower contact sections each has such a shape that the upper and lower contact sections, connected to each other, constitute a post which extends vertically when the substrate carrying tray, the upper tray and the lower tray are stacked on each other.

49. The stackable substrate carrying tray according to claim 30, wherein two or more substrates can be vertically placed and carried by a structure that three or more stackable substrate carrying trays are stacked.

50. The stackable substrate carrying tray according to claim 30, wherein the upper contact section contacting the upper substrate carrying tray which is stacked above said substrate carrying tray by only an angled portion of the upper contact section and the lower contact section contacting the lower substrate carrying tray which is stacked below said substrate carrying tray by only an angled portion of the lower contact section, and wherein the angled portion of the upper contact section and the angled portion of the lower contact section have equal width and the same inclination.

51. The stackable substrate carrying tray according to claim 30, wherein, at one end of the stackable substrate carrying tray, an entire slope of a surface for contact with the upper tray has only one of an upslope and a downslope toward the interior of the stackable substrate carrying tray.

52. The stackable substrate carrying tray according to claim 51, wherein, at any end of the stackable substrate carrying tray, the slope of the surface for contact with the upper tray shows a same variation of either an upslope or a downslope towards the interior of the stackable substrate carrying tray.

53. The stackable substrate carrying tray according to claim 30, wherein the loading bed includes a frame section whose inner perimeter is larger than an outer perimeter of the substrate, an upper surface of the frame section being lower than the upper contact section.

54. The stackable substrate carrying tray according to claim 53, wherein the frame section of the loading bed has such a shape that the upper substrate carrying tray is not in contact with the substrate when the substrate is placed on said substrate carrying tray.

55. The stackable substrate carrying tray according to claim 53, wherein the frame section of the loading bed has such a shape that there is a space between a lower end of the upper substrate carrying tray and an upper end of the frame section.

56. The stackable substrate carrying tray according to claim 53, wherein an upper end of the frame section of the loading bed is lower than an upper end of the upper contact section and higher than an upper end of the substrate placed on the substrate carrying tray.

* * * * *